US007687747B2

(12) United States Patent
Lee

(10) Patent No.: US 7,687,747 B2
(45) Date of Patent: Mar. 30, 2010

(54) ELECTROMAGNETIC HEATING CABLE AND WARMING MAT USING THE SAME

(76) Inventor: Myoung Jun Lee, 261 W. Rivera Ct., La Habra, CA (US) 90631

( * ) Notice: Subject to any disclaimer, the term of this patent is extended or adjusted under 35 U.S.C. 154(b) by 0 days.

(21) Appl. No.: 12/051,242

(22) Filed: Mar. 19, 2008

(65) Prior Publication Data

US 2008/0230536 A1 Sep. 25, 2008

(30) Foreign Application Priority Data

Mar. 21, 2007 (KR) ..... 10-2007-0027588

(51) Int. Cl.
*H05B 3/06* (2006.01)

(52) U.S. Cl. ..... 219/618; 219/539; 219/549

(58) Field of Classification Search ..... 219/635, 219/618, 661, 672, 676, 211–213, 528, 529, 219/546–553
See application file for complete search history.

(56) References Cited

U.S. PATENT DOCUMENTS 4,547,658 A * 10/1985 Crowley ..... 219/539
4,742,212 A * 5/1988 Ishii et al. ..... 219/549
2006/0186113 A1 * 8/2006 Daniels et al. ..... 219/549

FOREIGN PATENT DOCUMENTS

| | | |
|---|---|---|
| JP | 7263128 | 10/1995 |
| JP | 10335046 | 12/1998 |
| JP | 10335046 A * | 12/1998 |
| KR | 2002-0085991 | 11/2002 |
| KR | 2002-0093522 | 12/2002 |
| KR | 2004-0024351 | 3/2004 |

* cited by examiner

*Primary Examiner*—Quang T Van
(74) *Attorney, Agent, or Firm*—Lee, Hong, Degerman, Kang & Waimey

(57) ABSTRACT

An electromagnet heating cable includes a center core, an inner layer body formed around the center core, an intermediate layer body formed around the inner layer body, an outer layer body formed around the intermediate layer body, an inner layer coil having a magnetic core disposed between the center core and inner layer body, an intermediate layer coil disposed between the inner layer body and the intermediate layer body, and an outer layer coil disposed between the intermediate layer body and outer layer body, wherein when a temperature of the heating cable exceeds a threshold, the intermediate layer body melts to electrically connect the intermediate layer coil to the outer layer coil.

20 Claims, 6 Drawing Sheets

ELECTROMAGNETIC HEATING CABLE AND WARMING MAT USING THE SAME

CROSS-REFERENCE TO RELATED APPLICATIONS

Pursuant to 35 U.S.C. §119(a), this application claims the benefit of earlier filing date and right of priority to Korean Application No. 10-2007-0027588, filed on Mar. 21, 2007, the contents of which are hereby incorporated by reference herein in their entirety.

FIELD OF THE INVENTION

The present invention relates generally to an electromagnetic heating cable and a warming mat using the heating cable. Specifically, the present invention is directed to a heating cable in which two or more coils are included and an inner layer coil operates as an electromagnet and a warming mat using the heating cable.

DESCRIPTION OF THE RELATED ART

A temperature-sensitive heater has been used as a multi-coil heater. The temperature-sensitive heater is a heater that is used for bedding, such as an electric mat, an electric mattress, an electric cushion, and an electric bed, or clothes such as electric socks. A multi-coil heater is a cord-type heater that has a diameter ranging from 2 to 5 mm. The construction of a three-layer coil heater in which coils are arranged in three layers will be described below. A center core is sequentially triple-coated with an inner layer body, an intermediate layer body, and an outer layer body. An inner layer coil, an intermediate layer coil, and an outer layer coil are respectively disposed inside the inner layer body, the intermediate layer body, and the outer layer body.

In the three-layer coil, the inner layer coil and the outer layer coil are heating coils. The heating coils are connected in series to a driving current source and radiate heat generated by electric resistance. The ratio of the pitch of the inner layer coil to the pitch of the outer layer coil is theoretically 1 to 1 and the coils are spirally wound in opposite directions such that the intensity of electromagnetic waves radiated from the heating coils is attenuated.

The intermediate coil is a temperature detection coil. The intermediate coil comes into contact with the inner layer body, which is a nylon thermistor, and detects temperature voltage at a temperature control unit. At the same time, the intermediate coil is connected to an alternating current neutral terminal and emits electric field noise to neutral current.

The temperature control unit that drives the three-layer heater can set temperature, detect temperature voltage at the temperature detection coil and control a driving current ON/OFF switch in such a way that it is turned on if a detected temperature is lower than a set temperature and turned off if the detected temperature is equal to or higher than the set temperature. Since the driving current is supplied via a current fuse and a temperature fuse, which are encapsulated along with a heating resistor, the danger which may be caused by the use of electricity can be prevented.

The layer configuration of the prior art three-layer heater is listed in Table 1.

TABLE 1

Layer configuration of prior art three-layer heater

| Layer No. | Layer Name | Remarks |
|---|---|---|
| 1 | Center core | Electrical insulator |
| 2 | Inner layer coil | Connected in series to the outer layer coil<br>Enamel-coated copper heating coil |
| 3 | Inner layer body | Silicon insulating layer<br>Intermediate layer coil is inserted |
| 4 | Intermediate layer coil | Temperature detection coil<br>Spiral copper wire without coating<br>Coming in contact with nylon thermistor |
| 5 | Intermediate layer body | Nylon thermistor<br>Condenser capacity (value c) thereof varies with temperature |
| 6 | Outer coil | Heating coil connected in series to inner layer coil Enamel-coated copper wire |
| 7 | Outer layer body | PVC electrical insulator |

SUMMARY OF THE INVENTION

One embodiment of the present invention is to provide an electromagnetic heating cable including a center core, an inner layer body formed around the center core, an intermediate layer body formed around the inner layer body, an outer layer body formed around the intermediate layer body, an inner layer coil having a magnetic core disposed between the center core and inner layer body, an intermediate layer coil disposed between the inner layer body and the intermediate layer body, and an outer layer coil disposed between the intermediate layer body and outer layer body, wherein when a temperature of the heating cable exceeds a threshold, the intermediate layer body melts to electrically connect the intermediate layer coil to the outer layer coil.

According to one aspect of the present invention, the inner layer coil, which is separated from driving current, is magnetized when current flows through the outer layer coil and when the temperature of the heating cable exceeds the threshold, current flowing through the inner layer coil or the outer layer coil is applied as signal current to a temperature control unit to stop operation of the heating cable. Preferably, the center core, the inner layer body, the intermediate layer body and the outer layer body are electric insulators and the outer layer coil is a heating element. More preferably, the inner layer body includes a silicon electrical insulator layer that is installed to resist deep layer thermal load, the intermediate layer body includes a thermomeltable resin that melts at a temperature ranging from 95 to 267° C. and allows a temperature control unit to detect excessive heating, and the outer layer body is made of electrically insulating PVC.

Preferably, the inner layer coil includes an iron coil that operates as a magnet when the current flows through the outer layer coil, the intermediate layer coil includes a spiral copper wire that comes into contact with a nylon thermistor of the intermediate layer body and provides information regarding detected excessive heating to a temperature control unit, and the outer layer coil is a spiral copper coil. Also preferably, at least one of the inner layer coil, the intermediate coil, and the outer layer coil is a coil that is rolled flat.

According to another aspect of the present invention, the electromagnetic heating cable also includes a switch disposed between the outer layer coil and the inner layer coil. Preferably, the switch includes a first contact connection state, in which the inner layer coil and the outer layer coil are separated from each other, and the driving current is supplied to the outer layer coil such that the inner layer coil is magnetized and the outer layer coil operates as the heating element and a second contact connection state, in which the inner layer coil is connected in series to the outer layer coil such that polarities of the driving current can be reversed and the driving current is applied thereto, and thus, the inner layer coil and the outer layer coil operate as non-magnetic heating elements.

Another embodiment of the present invention is to provide a warming mat including an electromagnetic heating cable, wherein the electromagnetic heating cable includes a center core, an inner layer body formed around the center core, an intermediate layer body formed around the inner layer body, an outer layer body formed around the intermediate layer body, an inner layer coil having a magnetic core disposed between the center core and inner layer body, an intermediate layer coil disposed between the inner layer body and the intermediate layer body, an outer layer coil disposed between the intermediate layer body and outer layer body, and a switch which is disposed between the outer layer coil and inner layer coil, wherein when a temperature of the heating cable exceeds a threshold, the intermediate layer body melts to electrically connect the intermediate layer coil to the outer layer coil.

According to one aspect of the present invention, a first side of the outer layer coil is connected to a first side of the driving current, both ends of the outer layer coil of the heating cable are separated from the outer layer coil of the heating cable via a first contact connection, a second side of the outer layer coil is connected to a second side of the driving current via the first contact connection, and the second side of the outer layer coil and a second side of the inner layer coil are connected in series to each other via a second contact connection. Preferably, the driving current of the heating cable is direct current, the direct current being any one of a current that is obtained by voltage-reducing commercial alternating current using a voltage reducing transformer and rectifying voltage-reduced current using a rectifier, and switched power.

According to another aspect of the present invention, the warming mat also includes a temperature control unit having a temperature setting function and a temperature sensor connected to the temperature control unit, wherein the driving current is supplied to the heating cable through switching of the temperature control unit, the temperature control unit turning on a driving current switch of the heating cable such that input current is supplied to the heating cable if the temperature detected by the temperature sensor is lower than the threshold, and turning off the driving current switch of the heating cable such that the driving current being supplied to the heating cable is cut off if the temperature detected by the temperature sensor is higher than the threshold.

According to yet another aspect of the present invention, the warming mat further includes a current fuse on a driving current introduction line of the heating cable and/or a temperature fuse on a driving current introduction line of the heating cable.

BRIEF DESCRIPTION OF THE DRAWINGS

The above and other objects, features and advantages of the present invention will be more clearly understood from the following detailed description taken in conjunction with the accompanying drawings.

DESCRIPTION OF THE PREFERRED EMBODIMENTS

In the following detailed description, reference is made to the accompanying drawing figures which form a part hereof, and which show by way of illustration specific embodiments of the invention. It is to be understood by those of ordinary skill in this technological field that other embodiments may be utilized, and structural, electrical, as well as procedural changes may be made without departing from the scope of the present invention. Wherever possible, the same reference numbers will be used throughout the drawings to refer to the same or similar parts.

The present invention provides a heating cable in which an inner layer coil Lmc is magnetized when current flows through an outer layer coil L3. In order to provide a users body with a magnetic bath, permanent magnets are disposed in bedding or a cushion. The body is then exposed to magnetic fields that are generated around the permanent magnets. Notably, magnetic baths are known to improve the circulation of blood and reduce pain in the body.

Figure 4:
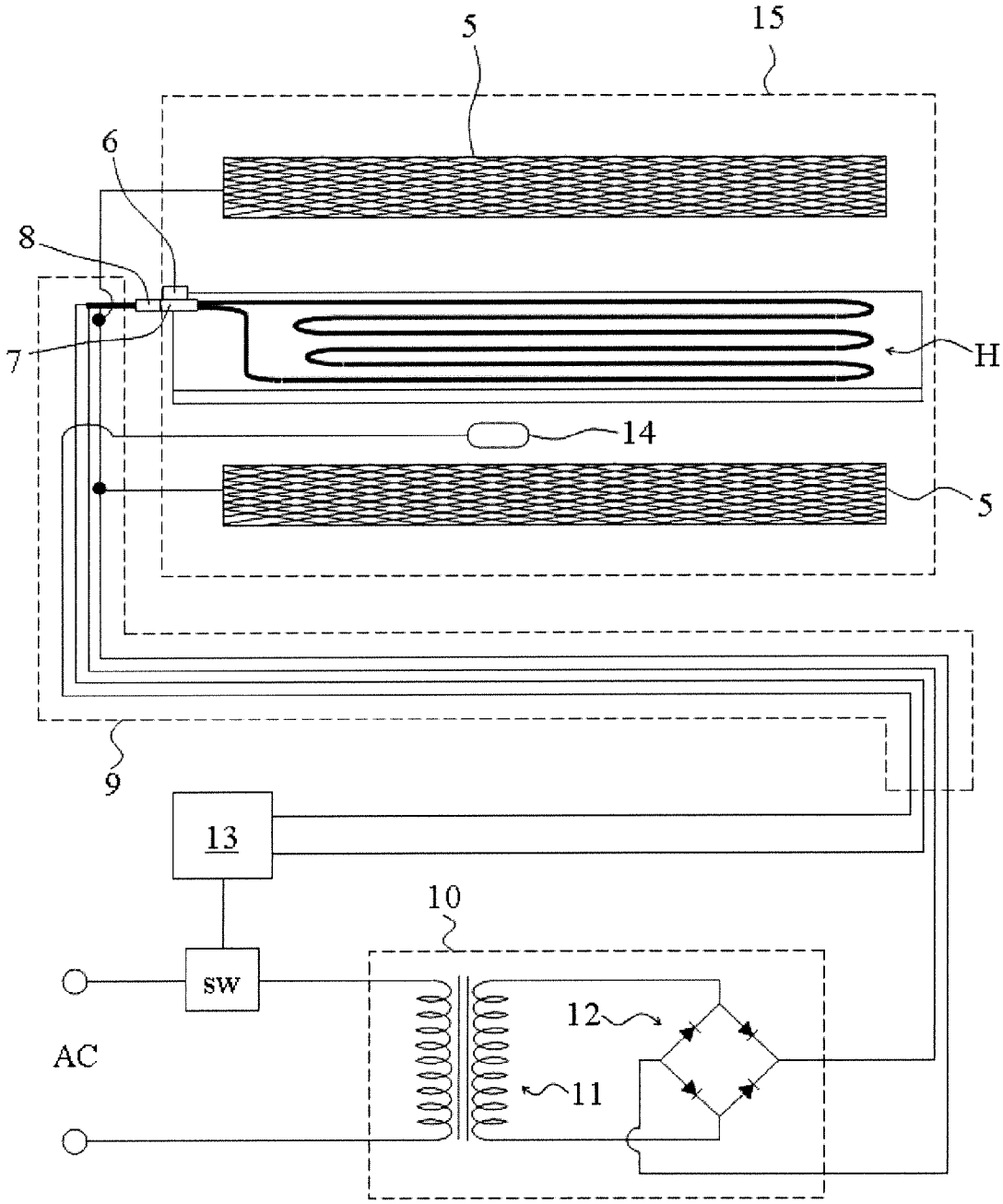
FIG. 4 is a diagram illustrating the electric wave shielding of the heating cable according to the present invention.
Figure 5:
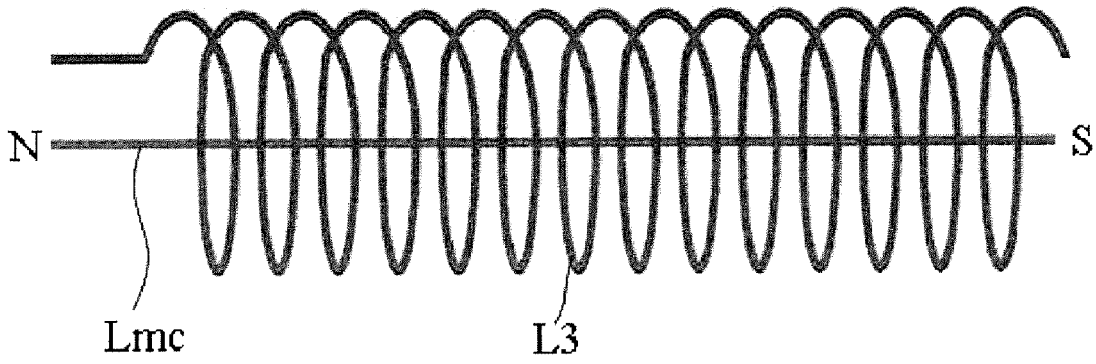
FIG. 5 is a diagram illustrating the magnetic operation of the heating cable according to the present invention.
Figure 6:
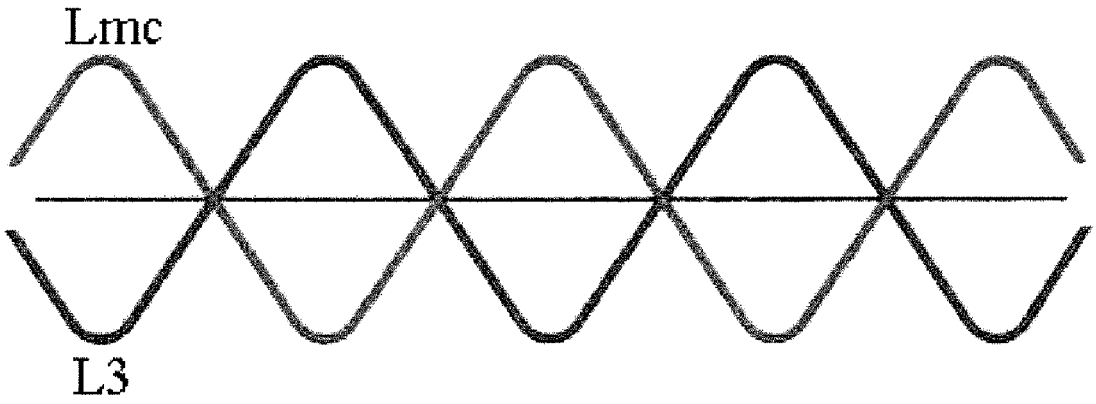
FIG. 6 is a diagram illustrating the electric field calculation of the heating cable according to the present invention.

FIG. 5 illustrates an operation in which the inner layer coil Lmc is magnetized by the outer layer coil L3. If direct current flows through the outer layer coil L3 and the inner layer coil Lmc is made of iron (Fe), which is a metal that is magnetized, both ends of the inner layer coil Lmc respectively form North (N) and South (S) poles that respectively correspond to the (−) and (+) poles of direct current. Accordingly, a stable magnetic field is formed between the opposite poles (N and S poles) of the magnet, as in a permanent magnet. The inner layer coil Lmc and the outer layer coil L3 are connected in series to a direct current source through the manipulation of a switch 6 (shown in FIGS. 2-4), and operate as heating elements.

Referring to FIGS. 1-4, in the present invention, the inner layer coil Lmc of a heating cable H is driven using an electromagnet such that a magnetic field is induced in warming products, such as an electric mattress, an electric cushion, and electric socks that employ the heating cable according to the present invention. The heating cable H according to the present invention includes multiple layer bodies, including a center core 1, an inner layer body 2, an intermediate layer body 3, and an outer layer body 4, which are electrical insulators. The heating cable H further includes a magnetic core inner layer coil Lmc which is disposed between the center core 1 and the inner layer body 2 and configured to be magnetized when it is separated from driving current and current flows through the outer layer coil L3. The heating cable H also includes an intermediate layer coil L2 which is disposed between the inner layer body 2 and the intermediate layer body 3, which is electrically connected to the outer layer coil L3. Preferably, the intermediate layer body 3 is configured to melt when the temperature of the heating cable is abnormally increased such that current flowing through the inner layer coil Lmc or outer layer coil L3 is applied to the temperature control unit 13 as signal current and is used to stop the driving of the heating cable through the above-described operation. The heating cable H further includes the outer layer coil L3 which is disposed between the intermediate layer body 3 and the outer layer body 4 and configured to operate as a heating element.

Figure 1:
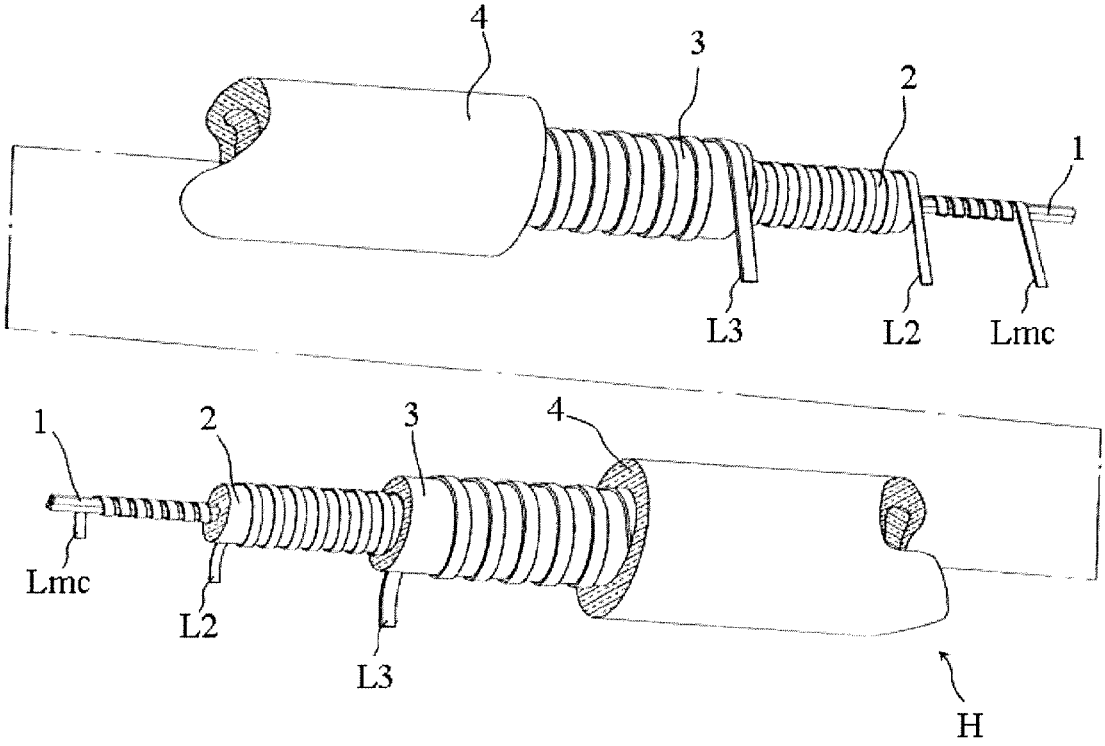
FIG. 1 is a partially cutaway view of a heating cable according to the present invention.

FIG. 1 is a diagram showing an embodiment of the heating cable according to the present invention. The inner layer body 2 includes a silicon electrical insulator layer that is configured to be resistant to a deep layer thermal load. The intermediate layer body 3 includes a thermomeltable resin that melts at a temperature ranging from 95 to 267° C. and electrically connects the intermediate layer coil L2 to the outer layer coil L3.

Examples of the thermomeltable resin that can be used as the intermediate layer body 3 are listed in Table 2.

TABLE 2

Thermomeltable polymers that can be used as intermediate layer body

| Polymer | Melting point (° C.) |
|---|---|
| Isotactic PS | 240 |
| Isotactic Poly (m-methylstyrene) | 215 |
| Isotactic PMMA | 160 |
| Syndiotactic PMMA | 200 |
| Nylon 66 | 267 |
| Polyethylene (high density) | 141 |
| Polyethylene (low density) | 95 |
| . . . | |

In accordance with one embodiment of the present invention, the intermediate layer body 3 is nylon that melts at 267° C. Preferably, the outer layer body 4 is PVC, which is an electrical insulator. Accordingly, if the heating cable H is abnormally heated and the intermediate layer body 3 melts, the silicon of the inner layer body 2 functions to keep the internal shape of the heating cable, thereby protecting the safety control operation of the temperature control unit 13. Since the intermediate layer body 3 and the outer layer coil L3 are coated with the outer layer body 4, the outer shape of the heating cable H is kept when the temperature control unit 13 performs a safe mode operation as well as when the heating cable is normally operated, thereby ensuring safety.

Preferably, the inner layer coil Lmc is an iron coil that operates as a magnet when current flows through the outer layer coil L3. The intermediate layer coil L2 is wound around the thermomeltable resin, and is configured to melt the resin and provide the driving current of the outer layer coil L3 to the temperature control unit 13 when the heating cable H abnormally reaches a temperature ranging from 120 to 160° C., or to apply current flowing through the outer layer coil to the temperature control unit when the electric insulating bodies 2, 3 and 4 are mechanically damaged due to strong external impact, excessive tensile stress or bending stress. Preferably, the outer layer coil L3 is a copper wire that is used to transmit the driving current of the outer layer coil to the temperature control unit 13. The copper wire is rolled to minimize the diameter of the heating cable H and is wound around the inner layer body 2.

Figure 2:
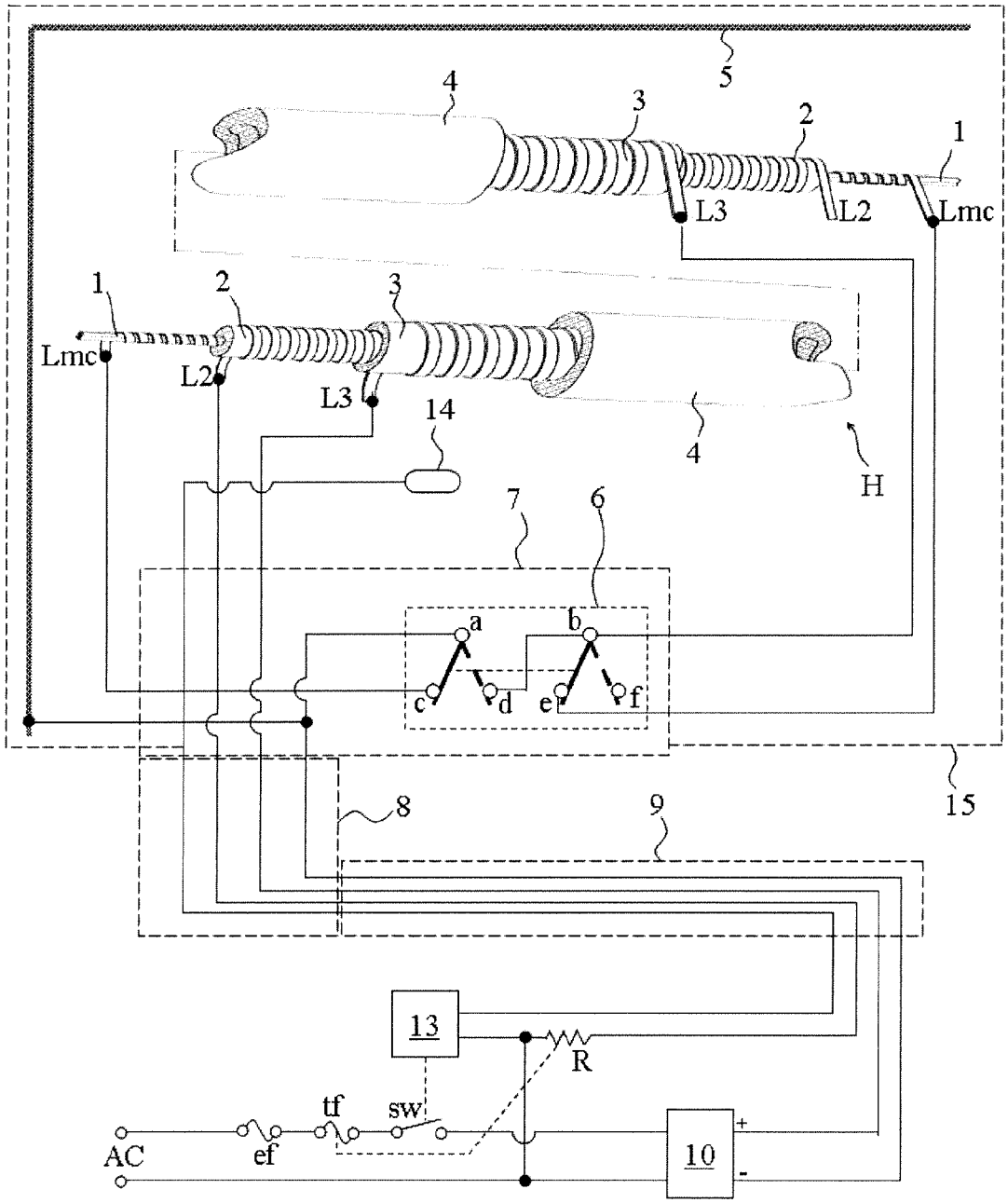
FIG. 2 is a circuit diagram showing the driving circuit of the heating cable according to the present invention.

As shown in FIG. 2, the switch 6 is provided between the outer layer coil L3 and the inner layer coil Lmc of the heating cable H. The switch 6 can change a state such that the inner layer coil Lmc, the core of the electromagnet, can operate as a heating coil. In a first contact connection state of the switch 6, the inner layer coil Lmc and the outer layer coil L3 are separated from each other and driving current is supplied to the outer layer coil such that the inner layer coil operates as an electromagnet while the outer layer coil operates as an heating element. In a second contact connection state of the switch 6, the inner layer coil Lmc is connected in series to the outer layer coil L3, driving current is applied thereto, and thus, the inner layer coil and the outer layer coil operate as heating elements.

In FIG. 2, the contacts a-f of the switch 6 convert the direct current polarities of both ends of the inner layer coil Lmc and the direct current polarities of both ends of the outer layer coil L3 into opposite polarities in order to operate the inner layer coil and the outer layer coil as non-magnetic heating wires during their operation. In more detail, due to the operation of the contacts of the switch 6, when a first side of the outer layer coil L3 is connected to the (+) side of the direct current power source, both ends of the inner layer coil Lmc are separated from the outer layer coil and a second side of the outer layer coil is connected to the (−) side of the power source via a first contact connection (b-d-a). In contrast, when the inner layer coil Lmc operates as a heating element, the first side of the outer layer coil L3 is connected to the (+) side of the power source, the first side of the inner layer coil is connected to the (−) side of the power source via the second contact connection (c-a), and the second sides of the outer layer coil and the inner layer coil are connected in series to each other via the second contact connection (b-e) of the switch 6. At the same time, the polarities of the inner layer coil Lmc and the outer layer coil L3 are oppositely set at both ends of the heating cable H.

Figure 3:
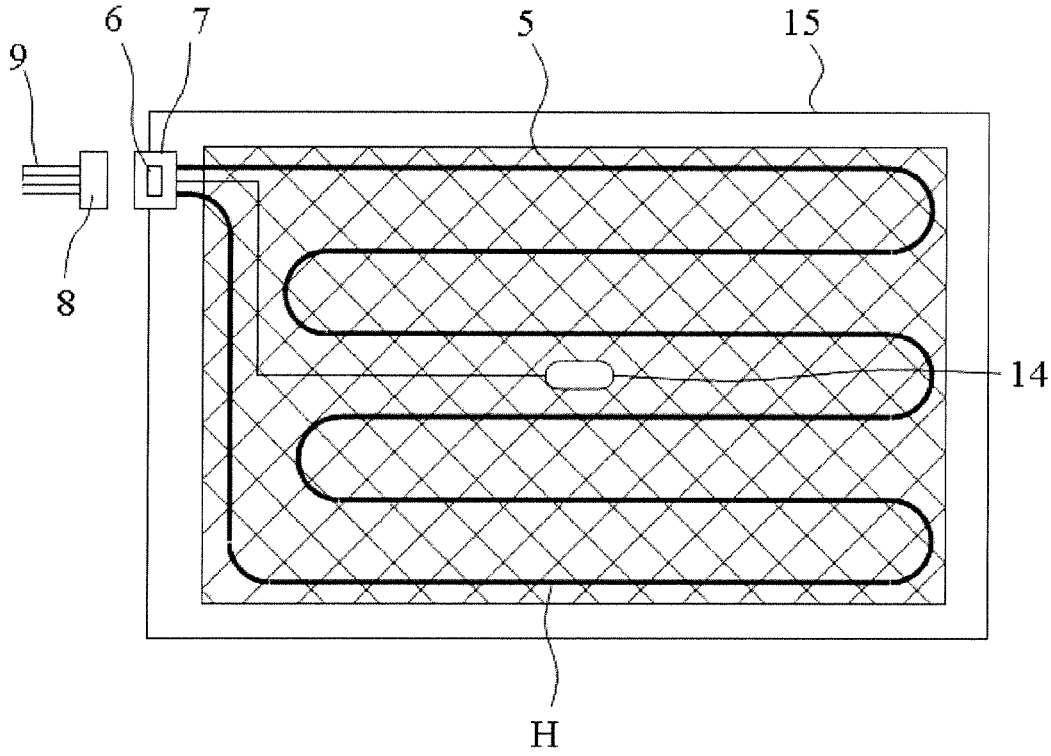
FIG. 3 is a plan view showing an example of the use of the heating cable according to the present invention.

Referring to FIGS. 3 and 4, the driving current for the heating cable H used for a warming mat 15 is direct current as described above, wherein the direct current is obtained from commercial alternating current via an A/D converter 10 that converts alternating current into direct current. As shown in FIG. 4, an A/D converter 10 may be formed of a voltage reducing transformer 11 and a diode rectifier 12. In FIG. 2, DC driving current provided by the A/D converter is provided to a connector 7 of the warming mat 15 via a cable 9 and a connector 8. When the inner layer coil Lmc is magnetized by the current output from the A/D converter 10, the polarities (N and S poles) of the magnet are not changed, and magnetic flux and a magnetic field generated in the warming mat 15 are stable similar to the magnetic field of a permanent magnet. Furthermore, because the driving current for the heating cable H is direct current, electromagnetic waves are not generated, unlike the case where electromagnetic waves are generated when alternating current is used.

A temperature sensor 14 is installed in the warming mat 15. The temperature sensor 14 is connected to the temperature control unit 13 having a temperature setting function via the connectors 7 and 8 and the cable 9. If the temperature detected by the temperature sensor 14 is equal to or lower than a set temperature, the temperature control unit 13 controls a heater driving current switch SW such that the heater driving the current switch is turned on, thereby supplying input current to the heating cable H. In contrast, if the temperature detected by the temperature sensor 14 is higher than the set temperature, the temperature control unit 13 controls the switch SW such that the switch is turned off, thereby shutting off the driving current supplied to the heating cable H. Furthermore, when the intermediate layer coil L2 detects the driving current of the outer layer coil L3, the temperature control unit 13 turns the switch SW off, thereby separating the heating cable H from the driving current. The temperature control unit 13 detects the driving current of the outer layer coil L3 at the intermediate layer coil L2 when the intermediate layer body 3 melts or the bodies 2, 3 and 4 of the heating cable H are damaged due to external force, and thus, the intermediate layer coil is electrically connected to the outer layer coil.

Another safety device included in the warming mat 15 is a temperature fuse tf. The temperature fuse tf includes a resistor R that radiates heat until the temperature fuse melts and cuts off while the driving current of the outer layer coil L3 flows through the intermediate coil L2 as described above. The temperature fuse tf, including the resistor R, is sealed. Since the warming mat 15 may cause current to approach the human body, the two safety devices described above are used to prevent the human body from being damaged by the current when the temperature control unit 13 stops working.

It is preferred that the inner layer coil Lmc, the intermediate layer coil L2 and the outer layer coil L3 be formed of coils that are rolled flat. The rolled coils are advantageous in that they do not penetrate into the supports, and thus, protect the supports because the flat surfaces of the coils come into contact with and are wound around the center core 1 and the bodies 2 and 3. Furthermore, the rolled coils with flat surfaces allow the diameter of the heating cable H to be smaller because they are thinner than unrolled coils.

In accordance with one embodiment of the present invention, the electromagnetic heating cable H of the present invention is manufactured by using polyester filament thread having a diameter ranging from 0.2 to 1.0 mm (700 denier) as a center core 1. An inner layer coil Lmc (magnetic core wire) is disposed around the center core using a rolled iron wire having a thickness ranging from 0.2 to 1.0 mm, into which an iron wire having a diameter ranging from 0.2 to 1.0 mm is rolled, forming an inner layer body 2 around the inner layer coil using extrusion-molded silicon rubber having a thickness ranging from 0.2 to 1.0 mm. An intermediate layer coil L2 (excessive heating detection coil) is disposed around the inner layer body using a rolled copper wire having a thickness ranging from 0.2 to 1.0 mm into which a copper wire having a diameter ranging from 0.2 to 1.0 mm is rolled, forming an intermediate layer body 3 around the intermediate layer coil using an extrusion-molded nylon thermistor made of nylon resin having a thickness ranging from 0.2 to 1.0 mm. An outer layer coil L3 (heating coil) is disposed around the intermediate layer body using a spiral copper wire having a thickness ranging from 0.2 to 1.0 mm into which a copper wire having a diameter ranging from 0.2 to 1.0 mm is pressed, and forming an outer layer body 4 around the outer layer coil using extrusion-molded PVC having a thickness ranging from 0.2 to 1.0 mm.

In accordance with one embodiment of the present invention, AC current at 220° C. may be converted into 24 V DC current via an A/D converter, and supplied to the outer layer coil L3, a heating element. A tip of a sensor of a temperature recorder may be connected to the outer layer coil and the voltage of the intermediate layer coil L2 may be measured while rising temperature is measured. For example, when a temperature of 156° C. is recorded in the temperature recorder, a DC voltage of 24 V, which is the voltage of the driving current of the outer layer coil L3, may be detected at the intermediate layer coil L2.

As described above, the present invention provides the warming mat 15 that includes a switch SW that allows the inner layer coil Lmc to operate as the core of a DC magnet or allows the inner layer coil and the outer layer coil L3 to be driven using current having reversed polarities. The present invention also provides the heating cable H that includes a center core 1, an inner layer body 2, an intermediate layer body 3, and an outer layer body 4, which are electric insulators. The present invention further includes an inner layer coil Lmc, an intermediate layer coil L2, and an outer layer coil L3 which constitute the heating cable H in which the inner layer coil may operate as an electromagnet in a multi-coil heating cable without generating electromagnetic waves using DC current as a driving current. When driving current is supplied only to an outer layer coil L3 of the heating cable H, the outer layer coil may operate as a heating element while the inner layer coil Lmc, separated from the outer layer coil, may operate as an electromagnet. The inner layer coil Lmc and the outer layer coil L3 may be connected in series to each other in the heating cable H such that both the inner layer coil and the outer layer coil operate as heating elements. The inner layer coil Lmc and the outer layer coil L3 may be connected in series to each other in the heating cable H such that the DC polarities of driving current, applied to both ends of the inner layer coil and the outer layer coil, are reversed during heating element operation, thereby canceling electromagnetic waves generated by the inner layer coil and the outer layer coil such that the heating cable exhibits non-magnetic characteristics. When the temperature of the heating cable H is abnormally increased, the intermediate layer body 3 melts, and thus, causes the intermediate layer coil L2 to come into contact with the outer layer coil L3, thereby preventing operation at excessive temperature. Furthermore, the warming mat includes a switch SW that allows an inner layer coil to operate as the core of a DC magnet or allows the inner layer coil and an outer layer coil to be driven using current having reversed polarities.

The foregoing embodiments and advantages are merely exemplary and are not to be construed as limiting the present invention. The present teaching can be readily applied to other types of apparatuses and processes. The description of the present invention is intended to be illustrative, and not to limit the scope of the claims. Many alternatives, modifications, and variations will be apparent to those skilled in the art.

What is claimed is:

1. An electromagnetic heating cable, comprising:

a center core;

an inner layer body formed around the center core;

an intermediate layer body formed around the inner layer body;

an outer layer body formed around the intermediate layer body;

an inner layer coil having a magnetic core disposed between the center core and inner layer body;

an intermediate layer coil disposed between the inner layer body and the intermediate layer body; and an outer layer coil disposed between the intermediate layer body and outer layer body, wherein the inner layer coil, which is separated from driving current, is magnetized when current flows through the outer layer coil and wherein when a temperature of the heating cable exceeds a threshold, the intermediate layer body melts to electrically connect the intermediate layer coil to the outer layer coil.

2. The electromagnetic heating cable of claim 1, wherein the intermediate layer coil is configured to melt the intermediate layer body when the temperature ranges from 120 to 160° C.

3. The electromagnetic heating cable of claim 1, wherein when the temperature of the heating cable exceeds the threshold, current flowing through the inner layer coil or the outer layer coil is applied as signal current to a temperature control unit to stop operation of the heating cable.

4. The electromagnetic heating cable of claim 1, wherein the center core, the inner layer body, the intermediate layer body and the outer layer body are electric insulators.

5. The electromagnetic heating cable of claim 1, wherein the outer layer coil is a heating element.

6. The electromagnetic heating cable of claim 1, wherein the inner layer body comprises a silicon electrical insulator layer that is installed to resist deep layer thermal load.

7. The electromagnetic heating cable of claim 1, wherein the intermediate layer body comprises a thermomeltable resin that melts at a temperature ranging from 95 to 267° C. and allows a temperature control unit to detect excessive heating.

8. The electromagnetic heating cable of claim 1, wherein the outer layer body is made of electrically insulating PVC.

9. The electromagnetic heating cable of claim 1, wherein the inner layer coil comprises an iron coil that operates as a magnet when the current flows through the outer layer coil.

10. The electromagnetic heating cable of claim 1, wherein the intermediate layer coil comprises a spiral copper wire that comes into contact with a nylon thermistor of the intermediate layer body and provides information regarding detected excessive heating to a temperature control unit.

11. The electromagnetic heating cable of claim 1, wherein the outer layer coil is a spiral copper coil.

12. The electromagnetic heating cable of claim 1, further comprising:

a switch disposed between the outer layer coil and the inner layer coil.

13. The electromagnetic heating cable of claim 12, wherein the switch comprises:

a first contact connection state, in which the inner layer coil and the outer layer coil are separated from each other, and the driving current is supplied to the outer layer coil such that the inner layer coil is magnetized and the outer layer coil operates as the heating element; and a second contact connection state, in which the inner layer coil is connected in series to the outer layer coil such that polarities of the driving current can be reversed and the driving current is applied thereto, and thus, the inner layer coil and the outer layer coil operate as non-magnetic heating elements.

14. The electromagnetic heating cable as set forth in claim 1, wherein at least one of the inner layer coil, the intermediate coil, and the outer layer coil is a coil that is rolled flat.

15. A warming mat, comprising an electromagnetic heating cable, wherein the electromagnetic heating cable comprises:

a center core;

an inner layer body formed around the center core;

an intermediate layer body formed around the inner layer body;

an outer layer body formed around the intermediate layer body;

an inner layer coil having a magnetic core disposed between the center core and inner layer body;

an intermediate layer coil disposed between the inner layer body and the intermediate layer body;

an outer layer coil disposed between the intermediate layer body and outer layer body; and a switch which is disposed between the outer layer coil and inner layer coil, wherein the inner layer coil, which is separated from driving current, is magnetized when current flows through the outer layer coil and wherein when a temperature of the heating cable exceeds a threshold, the intermediate layer body melts to electrically connect the intermediate layer coil to the outer layer coil.

16. The warming mat of claim 15, wherein:

a first side of the outer layer coil is connected to a first side of the driving current;

both ends of the outer layer coil of the heating cable are separated from the outer layer coil of the heating cable via a first contact connection;

a second side of the outer layer coil is connected to a second side of the driving current via the first contact connection; and the second side of the outer layer coil and a second side of the inner layer coil are connected in series to each other via a second contact connection.

17. The warming mat of claim 15, wherein the driving current of the heating cable is direct current, the direct current being any one of a current that is obtained by voltage-reducing commercial alternating current using a voltage reducing transformer and rectifying voltage-reduced current using a rectifier, and switched power.

18. The warming mat of claim 15, further comprising:

a temperature control unit having a temperature setting function; and a temperature sensor connected to the temperature control unit, wherein the driving current is supplied to the heating cable through switching of the temperature control unit, the temperature control unit turning on a driving current switch of the heating cable such that input current is supplied to the heating cable if the temperature detected by the temperature sensor is lower than the threshold, and turning off the driving current switch of the heating cable such that the driving current being supplied to the heating cable is cut off if the temperature detected by the temperature sensor is higher than the threshold.

19. The warming mat of claim 18, further comprising:

a current fuse on a driving current introduction line of the heating cable.

20. The warming mat of claim 18, further comprising:

a temperature fuse on a driving current introduction line of the heating cable.

* * * * *